US006455811B2

(12) United States Patent
Otsuka

(10) Patent No.: US 6,455,811 B2
(45) Date of Patent: Sep. 24, 2002

(54) IMAGE HEATING APPARATUS AND HEATER USED IN THIS APPARATUS

(75) Inventor: Yasumasa Otsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/891,388

(22) Filed: Jun. 27, 2001

(30) Foreign Application Priority Data

Jun. 29, 2000 (JP) ..... 2000-195944

(51) Int. Cl.[7] ..... H05B 3/00

(52) U.S. Cl. ..... 219/216; 219/469; 219/543; 349/328; 432/60; 118/60

(58) Field of Search ..... 219/216, 469–471, 219/543; 118/60; 399/328–338; 432/60, 228; 492/46

(56) References Cited

U.S. PATENT DOCUMENTS

| | | | | |
|---|---|---|---|---|
| 5,083,168 A | * | 1/1992 | Kusaka et al. | 355/285 |
| 5,210,579 A | | 5/1993 | Setoriyama et al. | 355/285 |
| 5,525,775 A | | 6/1996 | Setoriyama et al. | 219/216 |
| 5,592,276 A | * | 1/1997 | Ohtsuka et al. | 339/335 |
| 5,697,037 A | | 12/1997 | Yano et al. | 399/333 |
| 5,767,484 A | | 6/1998 | Hirabayashi et al. | 219/216 |
| 5,860,052 A | * | 1/1999 | Ohtsuka et al. | 399/329 |
| 5,877,928 A | | 3/1999 | Makino | 361/91 |
| 6,090,305 A | * | 7/2000 | Balch et al. | 219/216 |
| 6,094,559 A | | 7/2000 | Otsuka et al. | 399/327 |
| 6,175,699 B1 | | 1/2001 | Kato et al. | 399/69 |
| 6,248,978 B1 | * | 6/2001 | Okuda | 219/216 |

FOREIGN PATENT DOCUMENTS

| | | |
|---|---|---|
| JP | 2-157878 | 6/1980 |
| JP | 63-313182 | 12/1988 |
| JP | 4-44075 | 2/1992 |
| JP | 4-204980 | 7/1992 |
| JP | 5-66688 | 3/1993 |
| JP | 5-265350 | 10/1993 |
| JP | 7-334021 | 12/1995 |
| JP | 9-244442 | 9/1997 |
| JP | 10-257671 | 9/1998 |
| JP | 2000-29334 | 1/2000 |

* cited by examiner

*Primary Examiner*—Teresa Walberg
*Assistant Examiner*—Shawntina T. Fuqua
(74) *Attorney, Agent, or Firm*—Fitzpatrick, Cella, Harper & Scinto

(57) ABSTRACT

In a conductive board heater using metal as the board, since thermal expansion is large, and expansion and shrinkage are repeated in a heating apparatus, there is a defect that the electrode portion to which a power supply spring contact point on the power supply connecter side is pressurized and contacted is worn and contact inferior occurs and it is easy to break. Furthermore, since the position of the resistor pattern of the heating body varies, excessive heating, insufficient heating, uneven heating at an end portion, or uneven curl unevenness at a paper end is occurred. A heater in an image heating apparatus is provided so as to prevent a contact defect between an electrode and a connecter of image heating apparatus.

21 Claims, 11 Drawing Sheets

HEATER SURFACE SIDE

CONDUCTIVE BOARD HEATER

HEATER BACK SURFACE SIDE

IMAGE HEATING APPARATUS AND HEATER USED IN THIS APPARATUS

BACKGROUND OF THE INVENTION

1. Field of the Invention

The present invention relates to a heater particularly effective if it is used in a fixing apparatus of an image forming apparatus such as a copier or printer, and to an image heating apparatus using this heater.

2. Related Background Art

For convenience' sake, an image heating fixing apparatus as an example of a heating apparatus will be described.

In an image forming apparatus such as a copier, printer, or facsimile, an image heating fixing apparatus is a heating apparatus for heating/fixing-processing, on a recording material surface, an unfixed toner image corresponding to image information formed on the surface of a recording material (electro fax sheet, electrostatic recording sheet, transferring material sheet, print paper, or the like) in a direct or indirect (transferring) system using toner made of a thermomeltable resin or the like by proper image forming process means such as electrophotography, electrostatic recording, magnetic recording, or the like.

Conventionally, for such an image heating fixing apparatus, a heat roller system has been widely used. The heat roller system is a system which has a basic construction comprising a metallic roller provided therein with a heater, and a pressure roller having an elasticity and pressure-contacted to said roller, and in which, by passing a recording material through a fixing nip portion formed by one pair of these rollers, an unfixed toner image bore on said recording material is heated and pressurized to fix.

However, in the above heat roller system, since the heat capacity of the roller is large, very much time was required for raising the roller surface to a desired fixing temperature. Besides, for this reason, for quickly executing an image output operation, there is a problem wherein the roller surface must be temperature-adjusted to a temperature in a certain extent even when a machine is not used.

One improved and devised on that point is disclosed in Japanese Patent Application Laid-open No. 10-293490. This is composed by an insulating layer and a heat generation layer are laminated on a surface of a metallic roller. Such a roller is difficult in manufacture, besides, since a contact point for supplying an electric power to the roller slides, problems such as generation of noise and a short duration arise, so it does not reach a practical use in practice.

So, the present applicant has proposed before a heating apparatus of a film heating system (for example, see Japanese Patent Application Laid-open No. 63-313182, Japanese Patent Application Laid-open No. 2-157878, Japanese Patent Application Laid-open No. 4-44075, and Japanese Patent Application Laid-open No. 4-204980.

This film heating system is a system in which a heating body and a heated material are put into close contact with one surface side and the other surface side of a heat-resisting film, respectively, and the thermal energy of the heating body is given to the heated material through the heat-resisting film, and a heating apparatus of an on-demand type in which members of low heat capacity can be used for the heating body and film, there is quick startability, and the power consumption in standby is considerably small, can be constructed.

FIGS. 12A to 12C show one example of a heating apparatus of the film heating system. This example is an image heating fixing apparatus of the film heating system. FIG. 12A is an enlarged cross-section model view of a principal part, FIG. 12B is a partially cut-off plan model view on the surface side of a heating body, and FIG. 12C is a plan model view on the back surface side of the heating body.

Reference numeral 7 denotes a heating body, which is a slender and thin-plate-shaped member whose longitude is a vertical direction to the drawing surface of FIG. 12A, entirely low heat capacitive, and generates heat by being electrified.

Reference numeral 13 denotes a heating body support member, whose longitude corresponds to a vertical direction to a drawing surface of FIG. 12A, being adiabatic and rigid. On the lower surface side of this support member 13, along the member longitude, a seat gouged portion 13*a* elongating in the longitudinal axis and in shallow grooved shape into which the above heating body 7 can be fitted is comprised, and the heating body 7 is fitted into this seat gouged portion 13*a* and supported by the support member 13.

Reference numeral 12 denotes a thin heat-resisting film and 9 does an elastic pressure roller, the film is sandwiched, and the heating body 7 supported by the support member 13 and the pressure roller 9 are pressure contacted with a predetermined pressure force to form a fixing nip portion (heating nip portion) N.

The film 12 moves in an arrow direction with close contacting the fixing nip portion N to the surface on the downward facing side of the heating body 7 and sliding by a not-shown drive member, or the pressure roller 9 being rotation-driven.

And, when a paper leaf body (recording material) 11 carrying an unfixed toner image 10, as a heated material, is introduced between the film 12 of the above fixing nip portion N and the pressure roller 9, the paper leaf body 11 is sandwich-conveyed in the fixing nip portion N together with the film 12 and heated by heat from the heating body 7 through the film 12, and unfixed toner 10 is heat-fixed on the paper leaf body surface. The paper leaf body 11 passed through the fixing nip portion N is separated from the surface of the film 12 and conveyed.

As the heating body 7, a so-called ceramic heater in which a ceramic board having electrical-insulating performance, good heat conductivity and heat-resistivity is used as a heating body board. The heating body 7 of this example is a ceramic heater.

That is, 1 denotes a slender and thin-plate-shaped ceramic board.

Reference numeral 2 denotes first and second parallel two-stripe narrow-band-shape electrification heat-generation resistor patterns (one is a first, the other is a second) formed and comprised along the board longitude on the surface side of this ceramic board 1.

Reference numeral 5 denotes two conductor patterns (one is a first, the other is a second) as the first and second power supply electrodes (electrode contact points) formed and comprised with being arranged on the longitude one end portion side of the ceramic board surface. The first power supply electrode 5 is electrically conducted to one end portion of the first resistor pattern 2 through an extension pattern portion. Besides, the second power supply electrode 5 is electrically conducted to one end portion of the second resistor pattern 2 through an extension pattern portion.

Reference numeral 6 denotes a conductor pattern as a folded-back electrode formed and comprised on the ceramic board surface by electrically conducting between the other end portions of the first and second resistor patterns 2.

Reference numeral 3 denotes a heater surface protective glass layer, which is formed and comprised to cover substantially entirely the heater surface except the portion of the first and second power supply electrodes 5. By this protective glass layer 3, each extension pattern portion of the first and second resistor patterns 2 and the first and second power supply electrodes 5, and the folded-back electrode 6 are protected by being covered.

Reference numeral 4 denotes a temperature sensing element such as a thermistor or the like, which is disposed by being contacted to substantially the center portion in the longitudinal direction on the heater back surface side, that is, the back surface side of the ceramic board 1.

The surface side having the protective glass layer 3 of the above ceramic heater 7 is the film sliding surface side, and the surface side of this ceramic heater 7 is exposed to the exterior and fitted in the seat gouged portion 13*a* on the lower surface side of said support member 13 and disposed.

Reference numeral 8 denotes a power supply connecter. By predetermined fitness to the power supply connecter mounting portion of the support member 13 disposing and supporting the heater 7, first and second power supply spring contact points 8*a* on the power supply connecter 8 side are pressurized and contacted to the first and second power supply electrodes 5 of the heater 7, and the heater 7 and a not-shown power supply circuit are electrically connected.

By performing power supply from the power supply circuit through the power supply connecter 8 to the first and second power supply electrodes 5, by the electrification heat-generation resistor patterns 2 generating heat throughout the longitude entire length, the heater 7 rapidly raises the temperature. And, the temperature rising information is converted into voltage information by the temperature sensing element 7 disposed on the heater back surface side and detected, the output is calculated by a not-shown control circuit such as CPU or the like, and an AC input from the power supply circuit to the heater 7 is adjusted so that the temperature of the heater 7 is temperature-controlled to a predetermined temperature.

In the fixing apparatus adopting such a film heating system, since the film 12 of a low heat capacity and the heater 7 can be used, it becomes possible to shorten a wait time (quick start) as compared with the conventional heat roller system. Besides, since the quick start can be done, pre-heating upon non-print operation becomes unnecessary, and power-saving in a synthetic meaning can be intended.

By the way, as the ceramic heater of the above-described example, the heating body using the ceramic board such as alumina as the board has the problems that the ceramic is fragile, or, the cost is high, it is unsuitable for bending processing or the like, and the like.

So, in Japanese Patent Application Laid-open No. 9-244442, Japanese Patent Application Laid-open No. 10-275671, a heating body (hereinafter, referred to as conductive board heater) in which, by forming an insulating layer on a metal, a board having the same insulation ability as the conventional ceramic board is made, and a resistor pattern, a conductor pattern, and an insulating sliding layer of the uppermost layer are formed thereon is proposed.

However, in the conductive board heater using metal as the board, since thermal expansion is large, and expansion and shrinkage are repeated in a heating apparatus, there is a defect that the electrode portion to which the power supply spring contact point on the power supply connecter side is pressurized and contacted is worn and contact inferior occurs and it is easy to break.

Besides, since the position of the resistor pattern of the heating body varies, excessive heating, insufficient heating, uneven heating at an end portion, or uneven curl unevenness at a paper end is occurred.

SUMMARY OF THE INVENTION

The present invention has been made in view of the above problems, and its object is to a heater that can prevent contact defect between an electrode provided in the heater and a connecter of an image heating apparatus holding this heater, and an image heating apparatus using this heater.

Another object of the present invention is to provide a heater that can prevent heating defect by thermal expansion of the heater, and an image heating apparatus using this heater.

Still another object of the present invention is to provide an image heating apparatus having:

- a heating member for heating an image on a recording material, the heating member having a metallic substrate and heat generating resistor;
- a supporting member for supporting the heating member;
- wherein the metallic substrate having a positioning portion for positioning the metallic substrate on the supporting member.

Still another object of the present invention is to provide a heater having:

- a metallic substrate;
- a heat generating resistor;
- wherein the metallic substrate having a positioning portion for positioning the metallic substrate on the image heating apparatus.

Still another object of the present invention is to provide a heater having:

- a substrate, the substrate having a positioning portion for positioning the substrate on the image heating apparatus;
- a heat generating resistor;
- wherein the positioning portion is provided in the interior of the substrate.

Further objects of the present invention will become apparent by reading the below detailed description with reference to the accompanying drawings.

BRIEF DESCRIPTION OF THE DRAWINGS

FIGS. 3A, 3B and 3C are construction model views of a conductive board heater, in which FIG. 3A is a view representing a heater surface, FIG. 3B is a view representing a heater back surface, and FIG. 3C is a view representing a heater side surface;

FIGS. 5A, 5B and 5C are construction model views of another example of a conductive board heater, in which FIG. 5A is a view representing a heater surface, FIG. 5B is a view representing a heater back surface, and FIG. 5C is a view representing a heater side surface;

FIGS. 7A, 7B and 7C are construction model views of a conductive board heater of embodiment 2, in which FIG. 7A is a view representing a heater surface, FIG. 7B is a view representing a heater back surface, and FIG. 7C is a view representing a heater side surface;

FIGS. 9A and 9B are model views showing shapes upon expansion of the heater in a seat gouged portion of the stay, in which FIG. 9A shows a case of the heater in which positioning means is a board bending portion, and FIG. 9B shows a case of the heater in which the positioning means is a hole;

FIGS. 10A, 10B and 10C are construction model views of a conductive board heater of embodiment 3, in which FIG. 10A is a view representing a heater surface, FIG. 10B is a view representing a heater back surface, and FIG. 10C is a view representing a heater side surface;

FIGS. 12A, 12B and 12C are illustrative views of a heating apparatus of a film heating system and an example of a ceramic heater, in which FIG. 12A is an enlarged sectional view of a fixing portion, FIG. 12B represents a heater surface, and FIG. 12C represents a heater back surface view.

DETAILED DESCRIPTION OF THE PREFERRED EMBODIMENTS

Embodiment 1

(FIG. 1, FIG. 2, FIGS. 3A to 3C, FIG. 4, FIGS. 5A to 5C and FIG. 6)

(1) Example of Image Forming Apparatus

Figure 1:
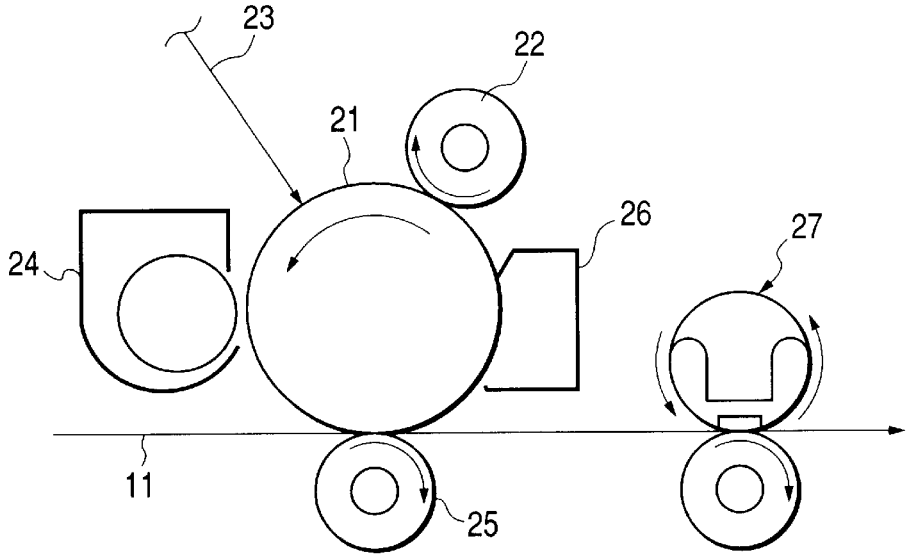
FIG. 1 is a schematic construction model view of one example of an image forming apparatus.

FIG. 1 is a schematic construction model view of one example of an image forming apparatus. The image forming apparatus of this example is a copier or printer utilizing a transferring type electrophotographic process, or a facsimile.

Reference numeral 21 denotes a drum-shape electrophotographic photosensitive body, which is rotated and driven counterclockwise of an arrow at a predetermined peripheral speed.

Reference numeral 22 denotes a charging roller, which is abutted on the photosensitive body 21 with a predetermined pressurizing force, and to which a predetermined charging bias is applied from a not-shown power source portion, thereby evenly charging processing the peripheral surface of the rotating photosensitive body 21 to a predetermined polarity and potential.

By performing image exposure 23 to the charging processing surface of the photosensitive body 21 by not-shown image exposure means (manuscript image projecting means, laser beam scanner, or the like), an electrostatic latent image corresponding to an exposure image pattern is formed on the photosensitive body surface. Reference numeral 24 denotes a developing apparatus, in which the electrostatic latent image on the photosensitive body surface is normal-developed or reverse-developed as a toner image.

Reference numeral 25 denotes a transferring roller, which is abutted on the photosensitive body 21 with a predetermined pressurizing force to form a transferring nip portion. By paper-feeding a transferring material sheet (leaf body) 11 to the transferring nip portion from a not-shown paper feeding portion at a predetermined timing, and applying a predetermined transferring bias to the transferring roller 25 from a not-shown power source portion, toner images on the photosensitive body 21 side are transferred in order to the surface side of the transferring material sheet 11 paper-fed to the transferring nip portion.

The transferring material sheet 11 passing through the transferring nip portion is separated from the photosensitive body 21 surface, conveyed to an image heating fixing apparatus 27, receives heat fixing processing of a carrying unfixed toner image, and paper-discharged.

Besides, the photosensitive body surface after the transferring material sheet separation receives removal of adhering remaining materials such as transferring remaining toner or the like by a cleaning apparatus 26 to be a pure surface, and is repeatedly subjected to image formation.

(2) Image Heating Fixing Apparatus 27

Figure 2:
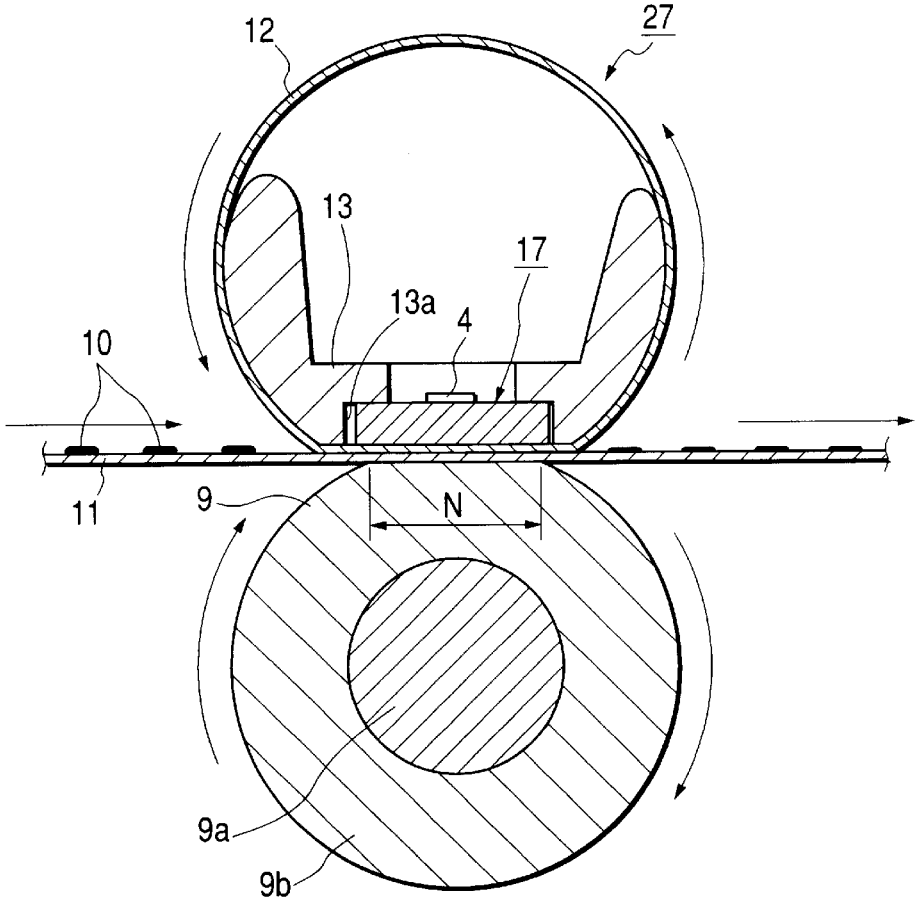
FIG. 2 is a schematic construction model view of a fixing apparatus.

The image heating fixing apparatus 27 of this example is a pressure roller drive type film heating system heating apparatus. FIG. 2 is a schematic construction view of the apparatus.

Reference numeral 17 denotes a conductive board heater as a heating body according to the present invention, which is a member slender and thin plate shape with a longitude in a vertical direction to the drawing and wholly low heat capacitive. The structure of this heater 17 will be described in detail in the next item (3).

Reference numeral 13 denotes a heating body support member of a substantially semicircular conduit shape in cross section (hereinafter, referred to as a stay), which is a member having heat resistibility and rigidity. On the lower surface side of this stay 13, along the stay longitude, a slender and bottom shallow groove shape seat gouged portion 13*a* into which the above conductive board heater 17 is fitted is comprised, and the conductive board heater 17 is fitted into this seat gouged portion 13*a* and supported by the stay 13.

Reference numeral 12 denotes a cylindrical thin heat-resisting film (fixing film), which is loosely outside-fitted to the stay 13 in which the heater 17 is disposed.

Reference numeral 9 denotes an elastic pressure roller as a pressure rotor. It comprises a core metal 9*a*, and a rubber elastic layer 9*b* good in mold release ability such as silicone rubber provided concentrically with said core metal 9*a*, and both end portions of the core metal 9*a* are supported through a bearing between not-shown chassis side plates of the apparatus to be free in rotation, respectively.

On the upper side of this pressure roller 9, the above heater 17 is disposed, the stay 13 on which the cylindrical film 12 is outside-fitted is oppositely disposed with the heater 17 side facing downward, a pushing-down force is made to act on the stay 13 by not-shown biasing means, and the facing-down surface of the heater 17 is pressurized and contacted to the upper surface of the pressure roller 9 with sandwiching the film 12 by a predetermined pressurizing force against the elasticity of the rubber elastic layer 9*b*. Thereby, the film 12 is sandwiched between the heater 17 and the elastic pressure roller 9 and a fixing nip portion N of a predetermined width is formed.

The pressure roller 9 is rotated and driven clockwise by not-shown drive means at a predetermined peripheral speed. A rotational force acts on the cylindrical film 12 by the pressure contact frictional force in the fixing nip portion N between the outer surface of said roller and the outer surface of the film 12 by the rotation of this pressure roller 9, and said film 12 becomes in a rotation state around the outside of the stay 13 with a peripheral speed substantially corresponding to the rotational peripheral speed to the pressure roller counterclockwise of an arrow with its inner surface is closely contacted and slid with the facing-down surface of the heater 17 in the fixing nip portion N (a pressure roller drive system).

The stay 13 functions also as a guide member of this rotating film 12. Reference numeral 13*b* (FIG. 4) denotes a rib in the film rotation direction provided by forming spaces along the longitude on the outer surface of the side wall portion of this stay 13. By the presence of this rib, the sliding resistance between the stay side wall portion outer surface and the rotation film inner surface is reduced.

Besides, by interposing a lubricating agent such as heat-resisting grease or the like between the facing-down surface of the heater 17 and the inner surface of the film 12, the rotation of the above film 12 can be made smoother.

In a state wherein the pressure roller 9 is rotated and driven, attendant upon this, the cylindrical film 12 becomes in a rotation state, the heater 17 is electrified as described later, and the fixing nip portion N rises to a predetermined temperature by heat generation of said heater 17 to be temperature-adjusted, the transferring material sheet 11 carrying the unfixed toner image 10 is introduced between the film 12 of the fixing nip portion N and the pressure roller 9, and, in the fixing nip portion N, the toner image carrying surface side of the transferring material sheet 11 comes into close contact with the outer surface of the film 12 and sandwich-transferred in the fixing nip portion N together with the film. In this sandwich-transferring process, the heat of the heater 17 is given to the transferring material sheet 11 through the film 12, and the unfixed toner image 10 on the transferring material sheet 11 is heated, melted, and fixed. After the transferring material sheet 11 passes through the fixing nip portion N, it is curvature-separated from the outer surface of the rotating film 12 and transferred.

(3) Conductive Board Heater 17

Figure 3A:
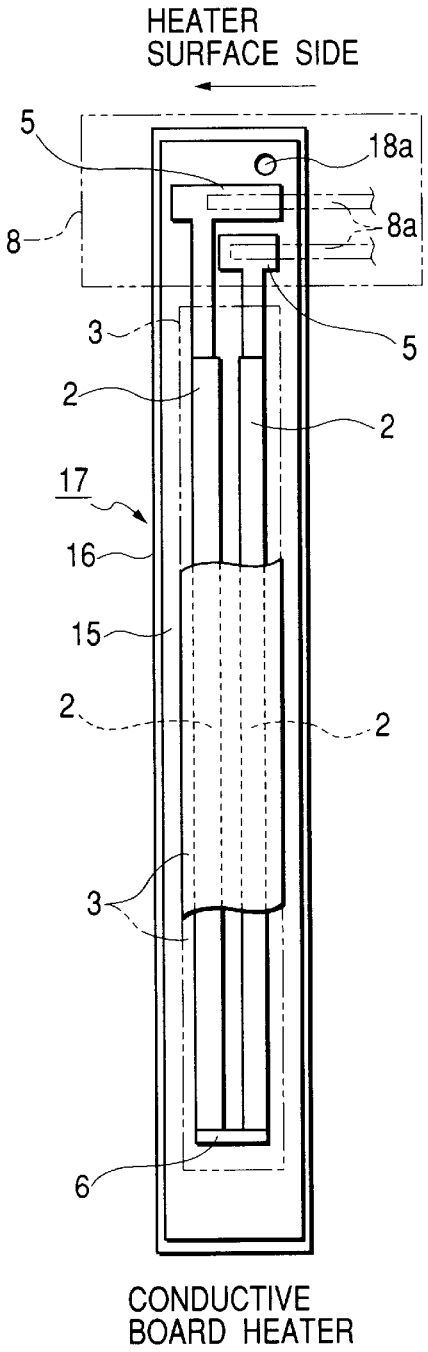
Figure 3B:
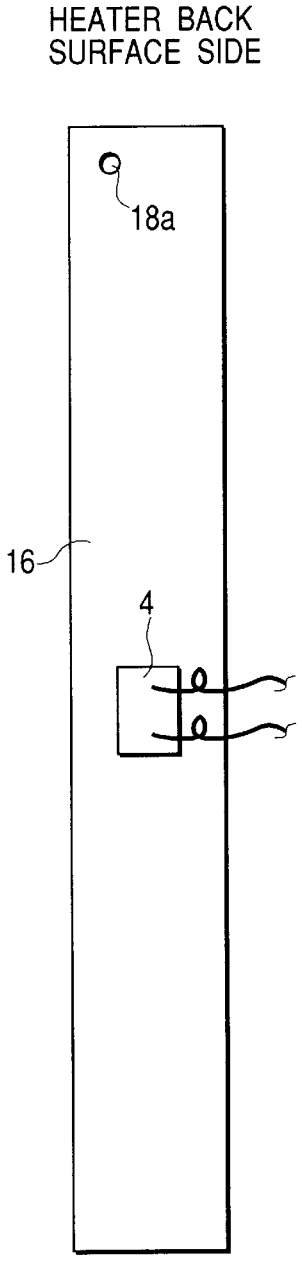
Figure 3C:
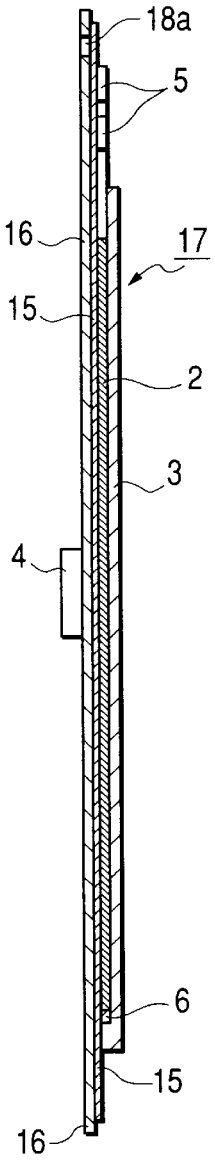

FIG. 3A is a partially cut-off plan model view on the surface side of the conductive board heater 17 of this example, FIG. 3B is a plan model view on the back surface side, and FIG. 3C is a vertical sectional model view.

Figures 12A, 12B, 12C:
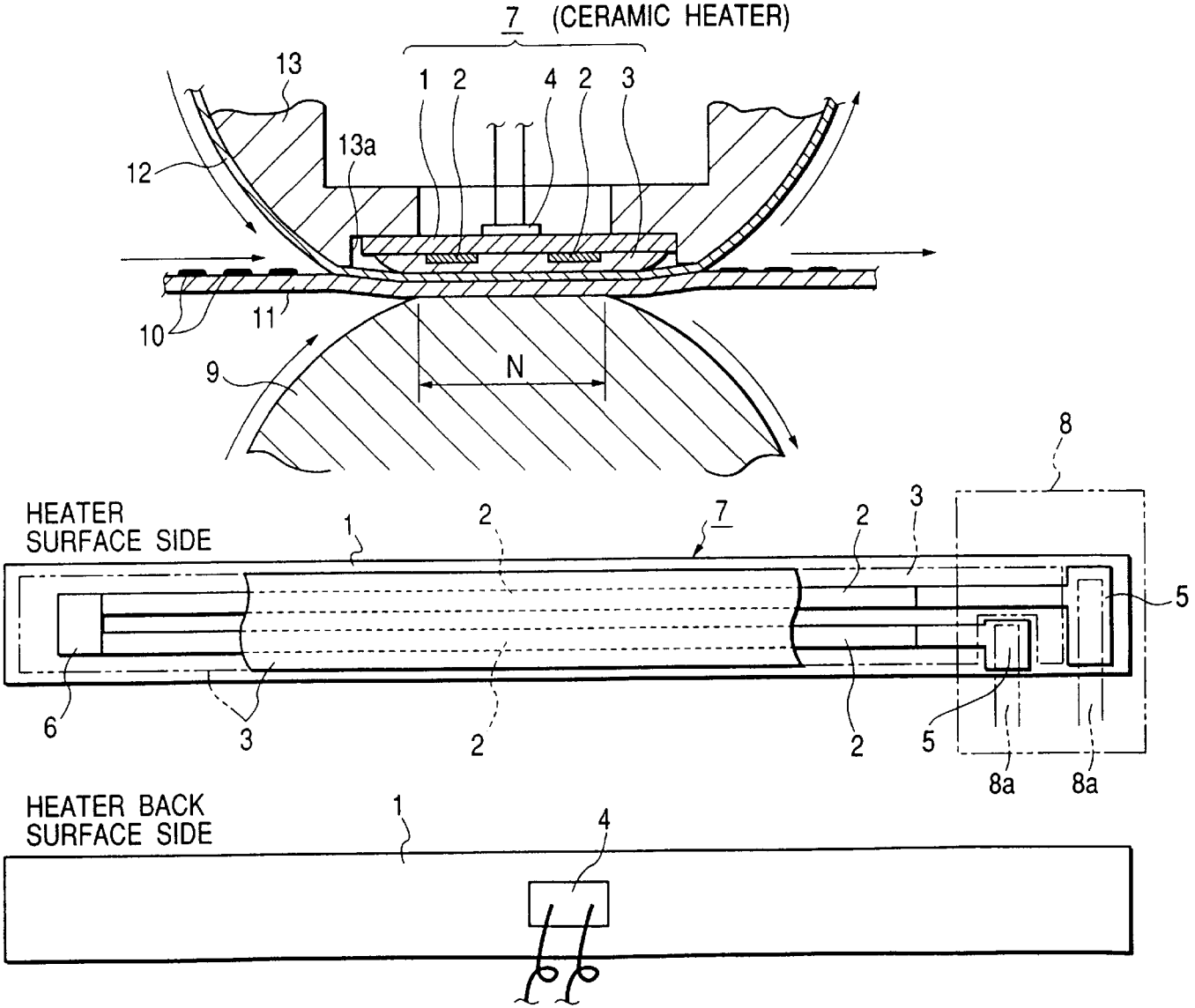
FIG. 12A (PRIOR ART)
FIG. 12B (PRIOR ART)
FIG. 12C (PRIOR ART)

This heater 17 forms an insulating glass layer 15 as a first insulating layer in almost the whole region of the surface of a conductive substrate (conductor substrate) 16. And, on this insulating glass layer 15, substantially similarly with the ceramic heater 7 of FIGS. 12A to 12C described before, first and second parallel two-stripe narrow-band-shape electrification heat-generation resistor patterns 2, conductor patterns 5 as first and second power supply electrodes, a conductor pattern 6 as a folded-back electrode, and a heater surface protective glass layer 3 as a second insulating layer are formed and comprised.

And, in part of the conductive substrate 16 of said conductive board heater 17, a punch-out processing hole 18*a* as means for positioning in relation to the stay 13 is provided.

For the conductive substrate 16, metal or the like such as SUS 430 whose coefficient of thermal expansion is easy to be matched to that of glass, is used. The length of said substrate 16 is desirable to be 270 mm, the width is desirable to be from 5 mm to 15 mm, and the thickness is desirable to be from 0.5 mm to 2 mm. If too thin, a great warp is generated after printing due to the difference in coefficient of thermal expansion and it becomes difficult to assembly. Besides, if too thick, the heat capacity of the heater becomes large, and, in case of abutting a thermistor or the like from the back surface, the response is delayed and a desirable control becomes difficult. This causes the generation of image problems such as fixing defect, luster unevenness, and offset.

For having a withstand voltage of 1.5 kV or more, the insulating glass layer 15 as the first insulating layer is formed into a thickness from 30 microns to 100 microns, and for preventing a pinhole, it is preferable to take a method of printing a plurality of times. Besides, to increase the adhesive performance between the conductive substrate 16 and this insulating glass layer 15, the conductive substrate 16 is roughing-processed by sand blast, etching, or the like, and after degrease, the insulating glass layer 15 may be printed. Since this insulating glass layer 15 serves for not only the withstand voltage but also preventing the heat generated in the resistor patterns 2 from escaping to the substrate 16 side, the coefficient of thermal conductivity is preferably equal to or less than 2 W/m.K.

Further, on this insulating glass layer 15, the resistor patterns 2 and the conductor patterns 5, 6 are printed.

Further, as the uppermost layer, the heater surface protective glass layer 3 is printed as the second insulating layer. For this protective glass 3, smoothness for slidability with the film 12 is required and insulating performance and a high thermal conductivity (preferably, equal to or more than 2 W/m.K or more) are required.

Ones such as the above glass layer, resistor patterns, and conductor pattern are made by baking after printing using screen printing, like the conventional ceramic heater.

The punch-out processing hole 18*a* as the means for positioning provided in part of the conductive substrate 16 of the heater is preferably provided within 90 mm from the electrode 5 for power supply.

Assuming that one having a length of 270 mm as a heater for A4 size is used at 200° C. of the temperature upon print, on the basis of the linear coefficient of thermal expansion of SUS 430, ($10.5\times10^{-6}$/° C.), as the conductive substrate 16, this is determined from the obtained amount of thermal expansion. The thermal expansion in the heater longitudinal direction in this case is calculated by the following expression.

$$(200-20)^\circ\ \text{C.}\times270\ \text{mm}\times10.5\times10^{-6}/^\circ\ \text{C.}=0.51\ \text{mm}$$

That is, an extension of about 0.5 mm over the entire heater length is calculated.

For the resistor patterns 2, a length for involving the width 216 mm of letter size is required.

But, the positions of both ends of this resistor patterns 2 are determined by the positional relationship in a state of being thermally expanded in a use temperature.

A holding method of the conventional heater to the stay is either fixed or completely free at both ends.

In the former case, by thermal expansion, the heater fixing portion becomes a knot and the unfixed portion becomes a belly, causing the generation of unevenness in the pressure distribution. In the latter case, the position of the resistor pattern is difficult to be determined, and the wear of the electrode is intense.

From this, unless the vicinity of the electrode 5 for power supply of AC of the heater is positioned, friction is generated between the spring contact point 8*a* of the connecter and the electrode 5 every time when being electrified, the electrode 5 is gradually shaved, and finally, a problem that the contact resistance increases, heat is generated, and the electrode is baked and broken, is generated.

From the experience of an alumina heater of 270 mm that does not adhere to the conventional stay 13, the thermal expansion becomes 0.34 mm over the entire length. Considering by distributing this to both sides, up to 0.17 mm, it is thinkable that there is no problem even if there is a shift of the contact point.

Accordingly, for suppressing the movement of the contact point within this 0.17 mm, the distance from the positioning means 18*a* to the electrode 5 is preferable to be $$270 \times 0.17/0.51 \approx 90 \text{ mm}$$

As the distance from the electrode position, the farthest one from the positioning means 18*a* of the electrodes 5, which is two, is measured.

If the connecter 8 is inserted from the arrow direction of FIGS. 3A to 3C and FIG. 4, in further both the contact electrodes 8*a* of the connecter 8, sliding friction is reduced and the reliability of conductivity increases.

Figure 4:
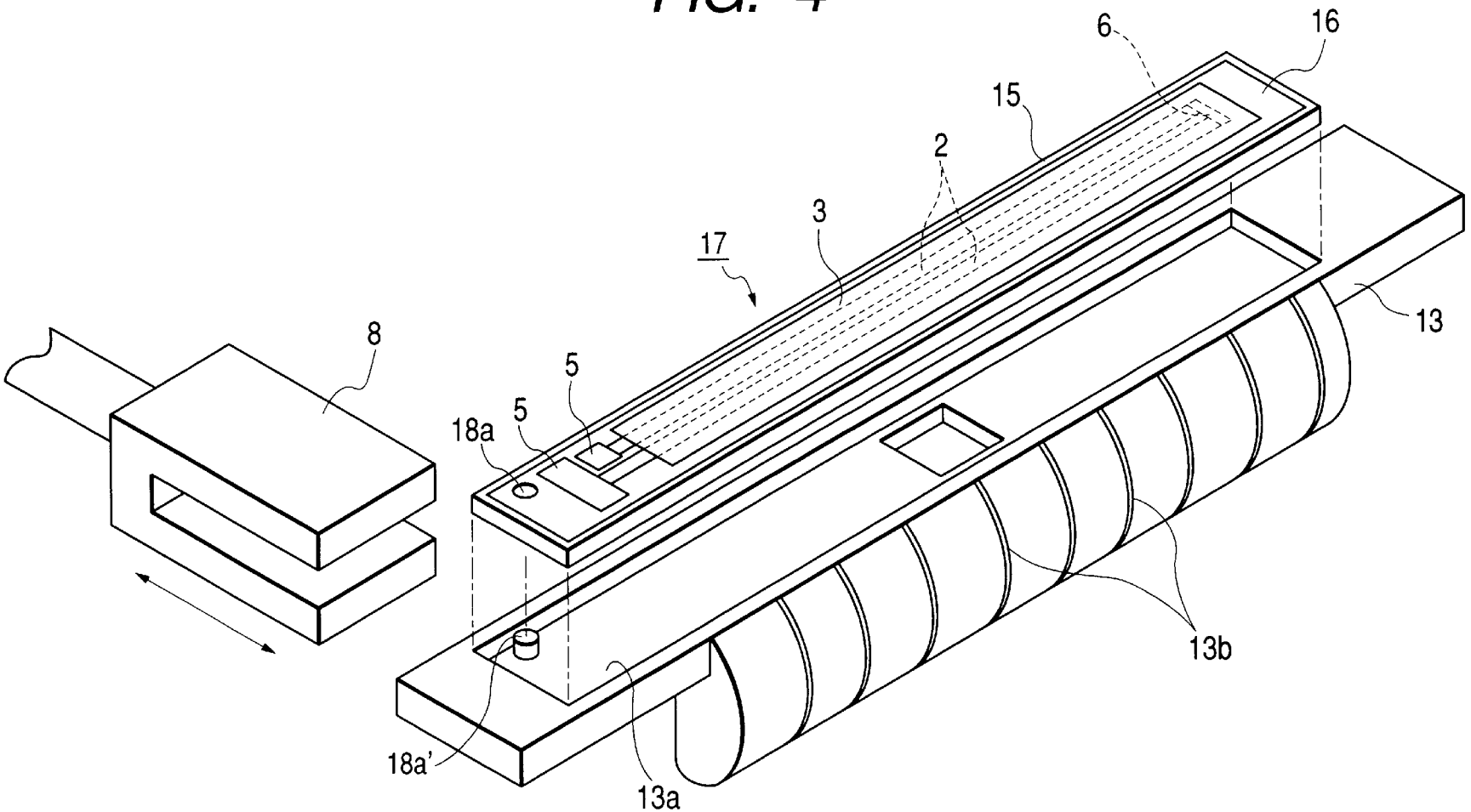
FIG. 4 is an exploded perspective model view of the heater and a stay.

FIG. 4 is a view showing the shape of the stay 13 for mounting the heater 17, in which pin-like positioning means 18*a*' fitting to correspond to the punch-out hole 18*a* as the positioning means on the heater 17 side is provided on the stay 13. The shape relationship between the positioning portion of the heater and the positioning portion of the stay is interchangeable. Besides, the heater is not adhered to the stay.

For the stay 13, one whose strength is increased by inserting glass in a heat-resisting resin such as PPS, liquid crystal polymer, or phenolic resin, is used. These resins are used by injecting a mold for molding. By manufacturing this mold into a shape for molding into the positioning means 18*a*', the positioning means 18*a*' can be made.

Note that the positioning means 18*a* on the heater 17 side may be not the hole but a boss or emboss.

Figure 5A:
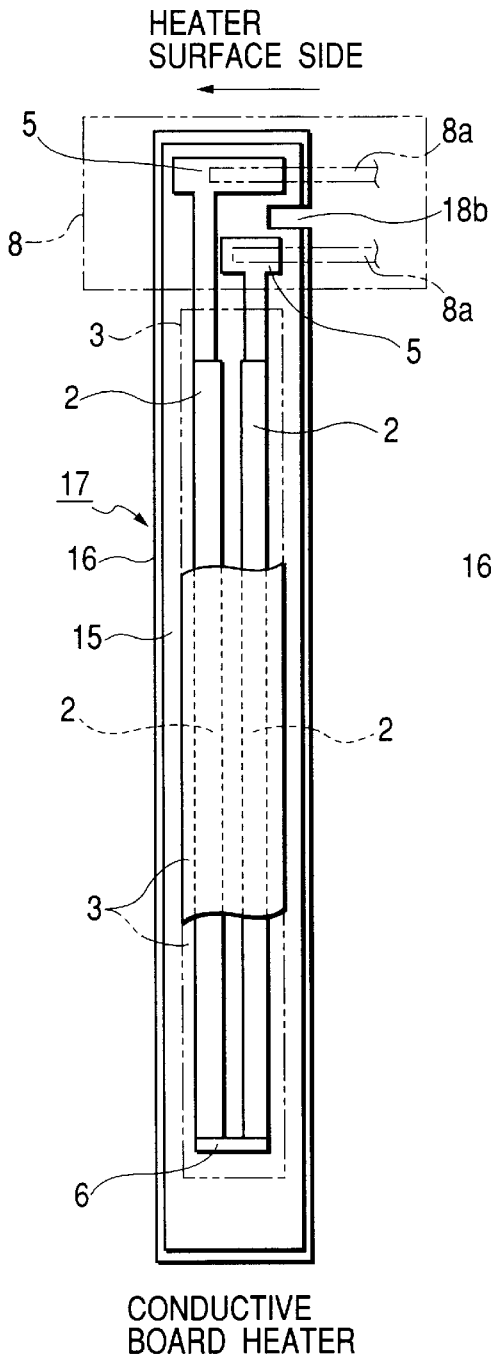
Figure 5B:
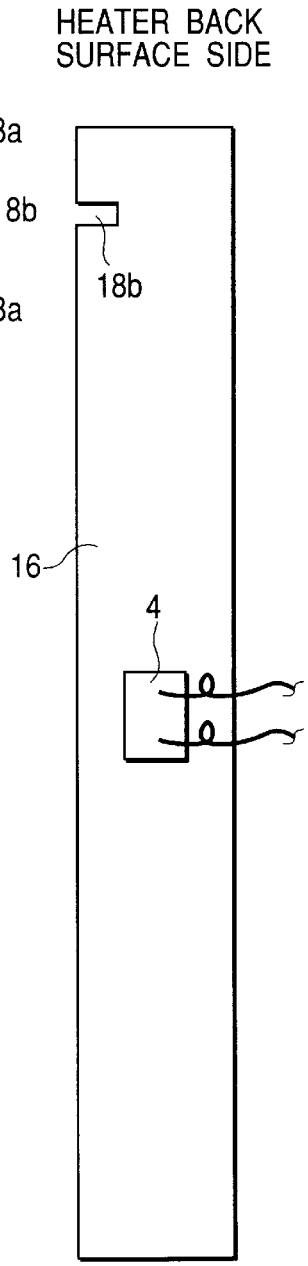
Figure 5C:
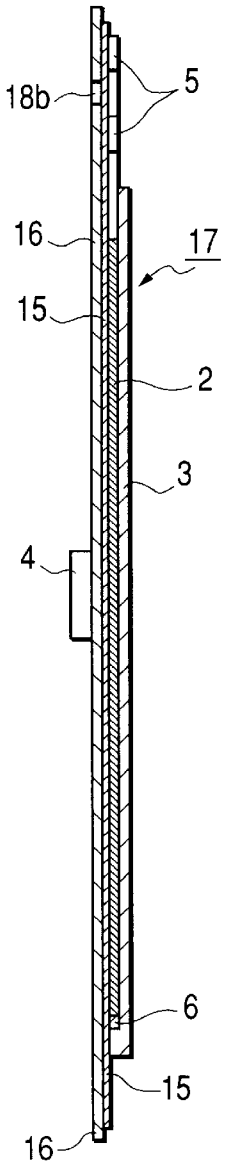
Figure 6:
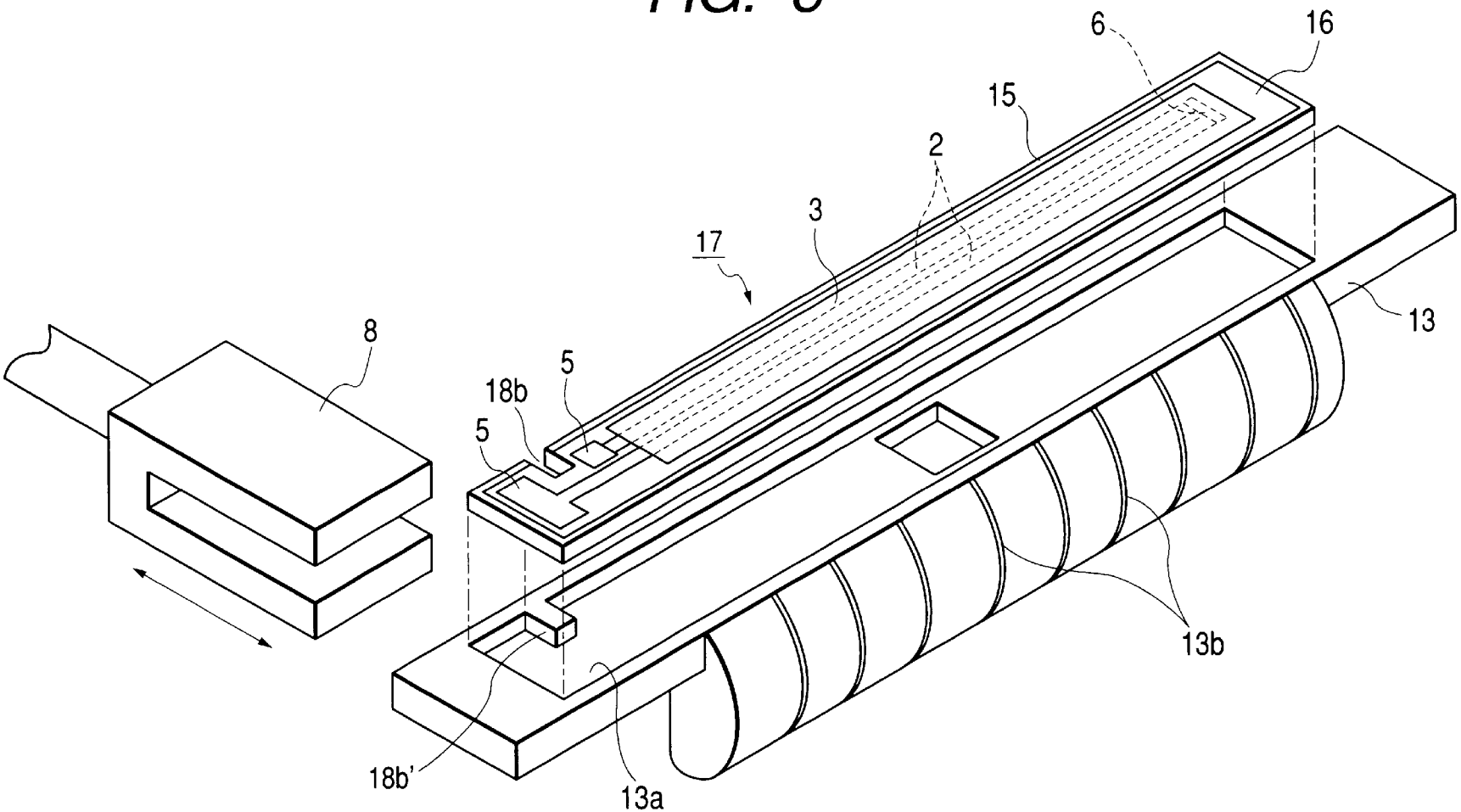
FIG. 6 is an exploded perspective model view of the heater and a stay.
Figure 7A:
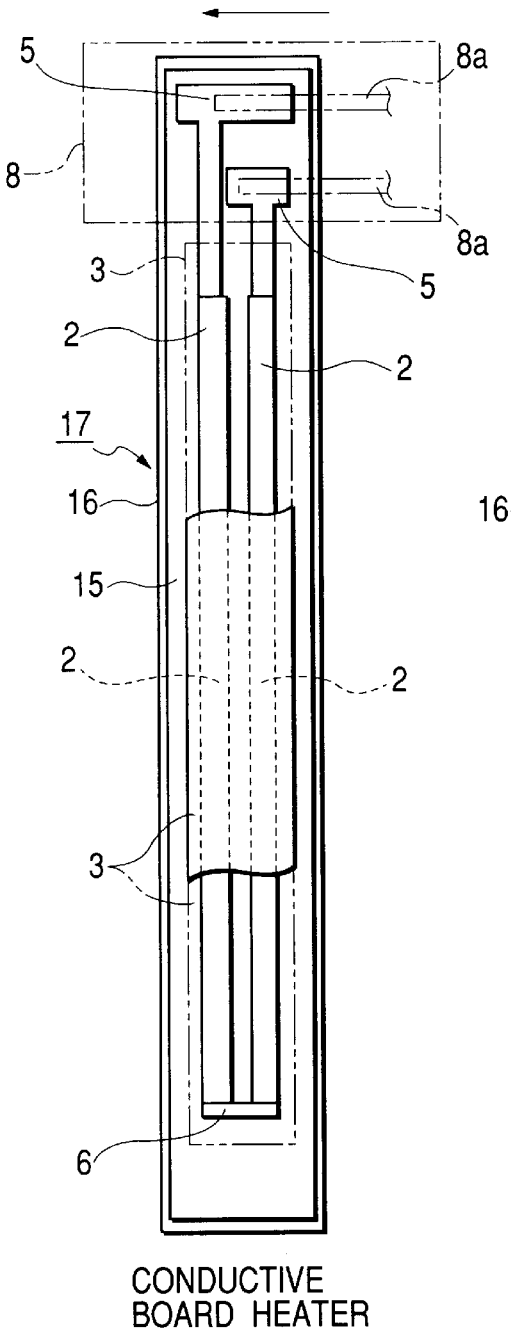
Figure 7B:
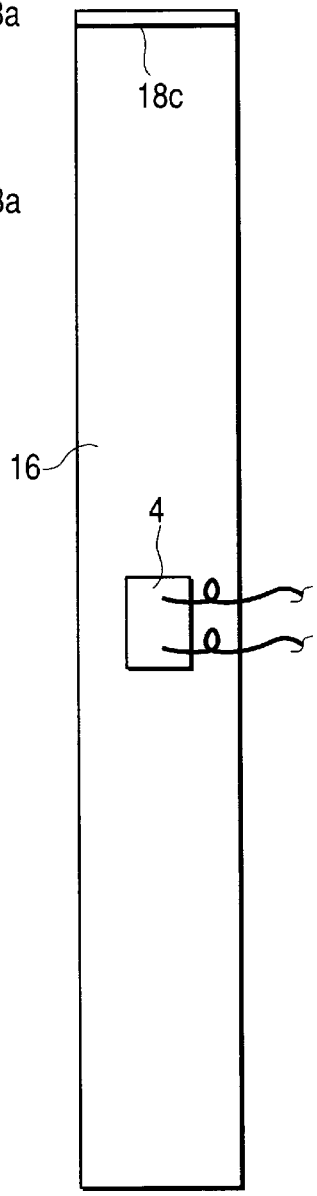
Figure 7C:
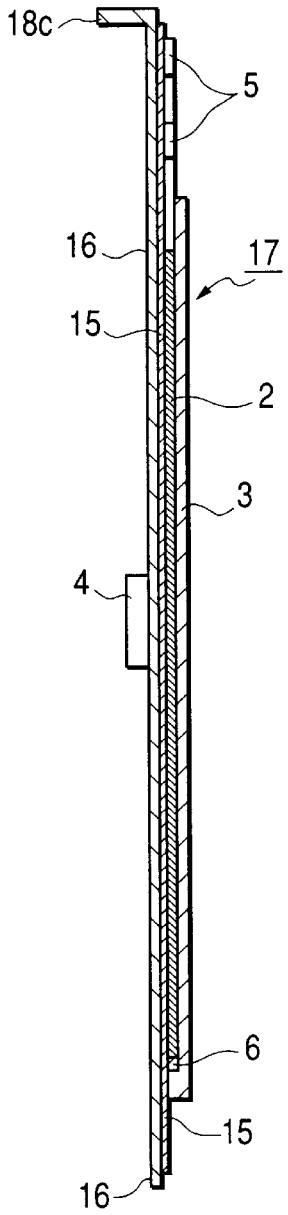

Or, as shown in FIGS. 5A to 5C, a notch portion 18*b* on the heater side is used as the positioning means, and the fitting portion of the stay 13 side may be a projection 18*b*' as shown in FIG. 6.

The works of the above positioning means 18*a* and 18*a*', 18*b* and 18*b* ' are effective also for accurately disposing the positions of the electrification heat-generation body patterns 2 of the heater 17 in the fixing nip portion N in relation to the passing position of the transferring material sheet 11 as the heated material. In the conventional ceramic heater, for reducing stress, ones that do not adhere are more. However, since this makes inaccurate the position in the longitudinal direction in the stay interior, in order that the resistor pattern goes out to the exterior of the pressure roller, the dimension in the longitudinal direction of the heating body must have a margin. Since this becomes large as about 2 mm on one side, it is undesirable on cost and for making the apparatus structure small.

However, as this embodiment, if the standards 18*a* and 18*a*', 18*b* and 18*b*' for positioning are provided on one side, since the positions of the resistor patterns 2 can be accepted within ±0.4 mm that is the sum of the fitting tolerance ±0.1 mm of this portion and the tolerance 0.3 mm of screen printing, since the accuracy is very good and the heat of the transferring material sheet end portion is given as designed, there is no occurrence of curl and end portion fixing defect.

Embodiment 2

(FIGS. 7A to 7C, FIG. 8, FIGS. 9A and 9B)

In the heater 17 of this embodiment, as shown in FIGS. 7A to 7C and FIG. 8, a board bending portion 18*c* as positioning means is provided at a longitudinal direction end of the conductive substrate 16. To correspond to this, a fitting groove portion 18*c*' as positioning means in which said board bending portion 18*c* is fitted and engaged is comprised on the stay 13 side.

Bending processing 18*c* of this heater 17 can cope with not only an extension in the longitudinal direction of the heater 17 but also the revolution movement.

Figure 8:
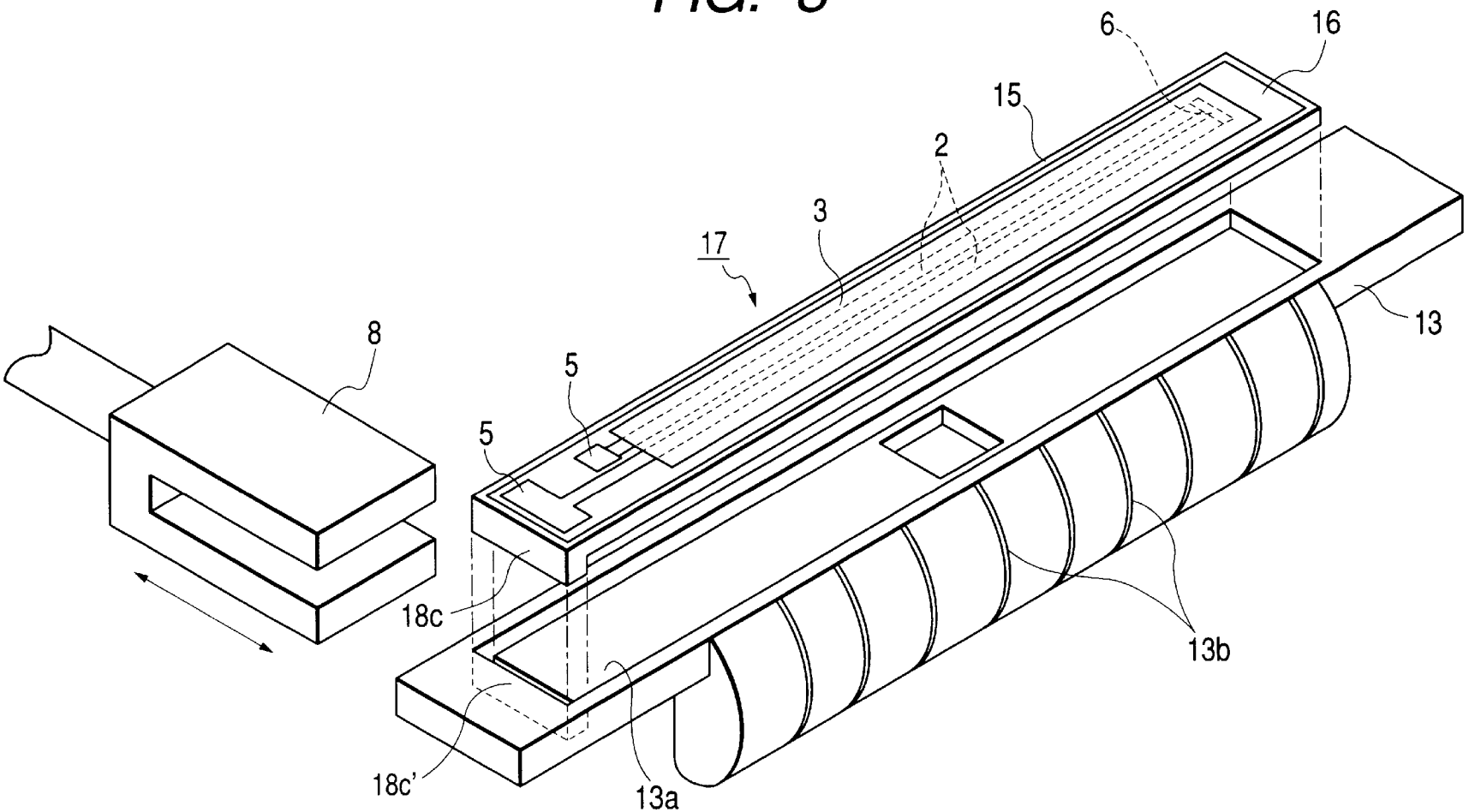
FIG. 8 is an exploded perspective model view of the heater and a stay.

That is, although, usually, in the heater, when the recording material 11 at a room temperature enters in the fixing nip portion N, the temperature on the transferring upstream side becomes low, and for this reason, a warp is generated due to the thermal expansion difference between the upstream and downstream, as shown in FIG. 8, since the region in which the revolution movement can be done in the fitting gap to the fitting groove 18*c*' as the positioning means on the stay 13 side is regulated by one side standard, the movement on the electrodes 5 side can be suppressed to 0.1 mm or less in which the wear due to sliding friction becomes no problem.

Since a temperature difference of nearly 80° C. is generated between the upstream and downstream of the usual heater, an extension difference of 0.23 mm is generated. This appears to be about 0.5 mm as a warp. In the conventional ceramic heater, since this is also distributed in the left and right and also in the upstream and downstream, it is small as 0.125 mm, which becomes no problem. However, in case of completely stopping the extension on one side, a large displacement appears at a free end portion. Accordingly, on the free end side, it is unsuitable for disposing an electrode.

To realize this embodiment, if the positioning means is one of the hole 18*a* as shown in FIGS. 3A to 3C and FIG. 4, if the clearance between the hole and the stay side is taken to be small as about 0.1 mm, the revolution movement can be regulated likewise, but, in this case, in order that the left and right are disposed symmetrically, the position of the positioning means 18*a* may be determined. However, in case of using the notch 18*b* as shown in FIGS. 5A to 5C and FIG. 6, since there is no restriction force to the warp direction, it is unsuitable.

Figure 9A:
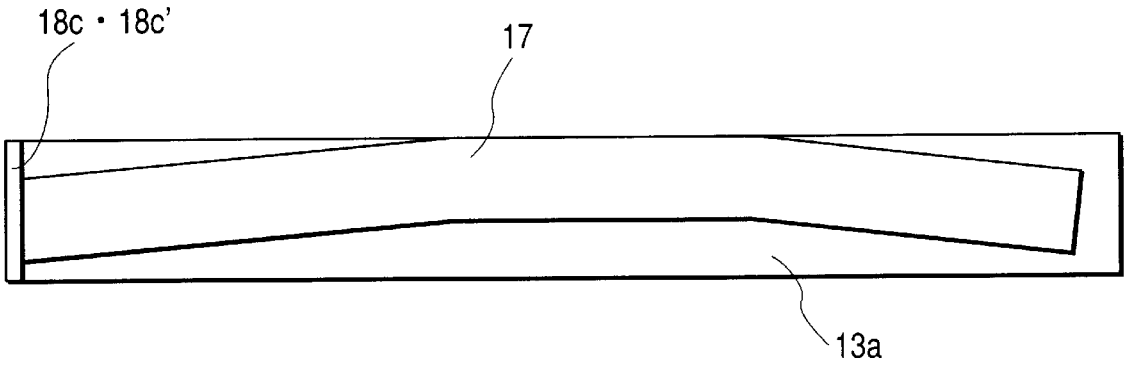
Figure 9B:
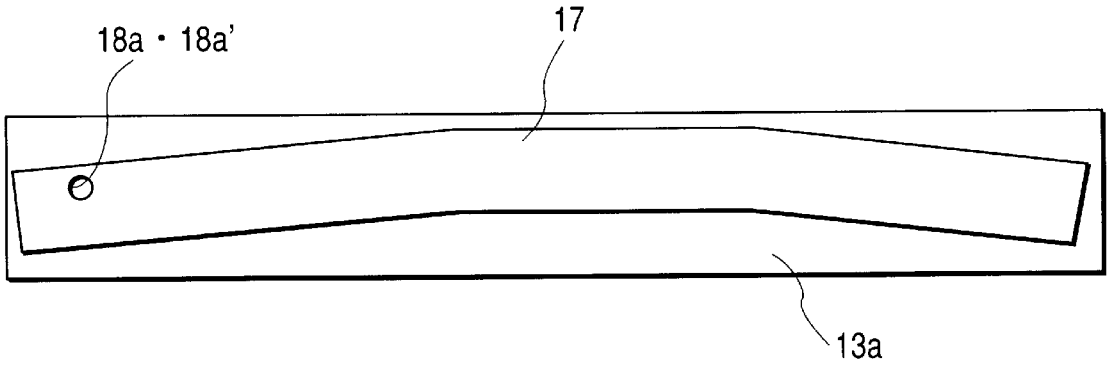
Figure 10A:
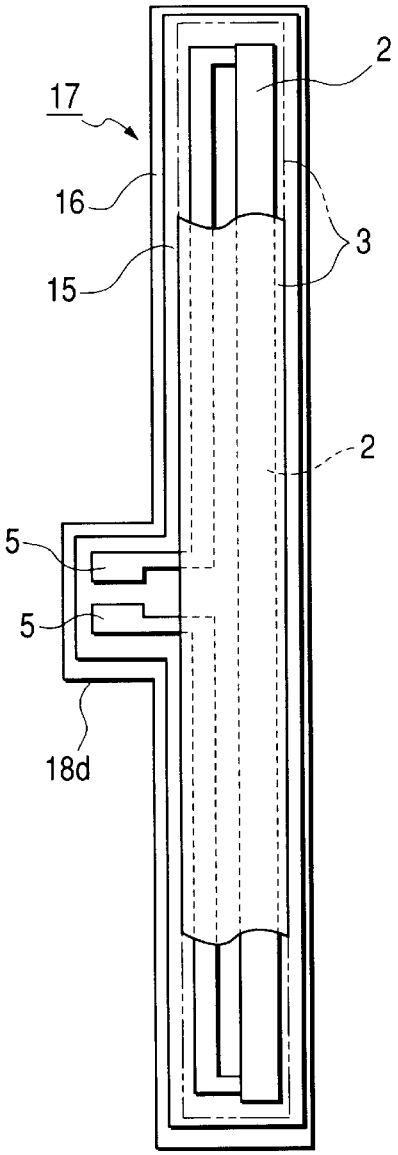
Figure 10B:
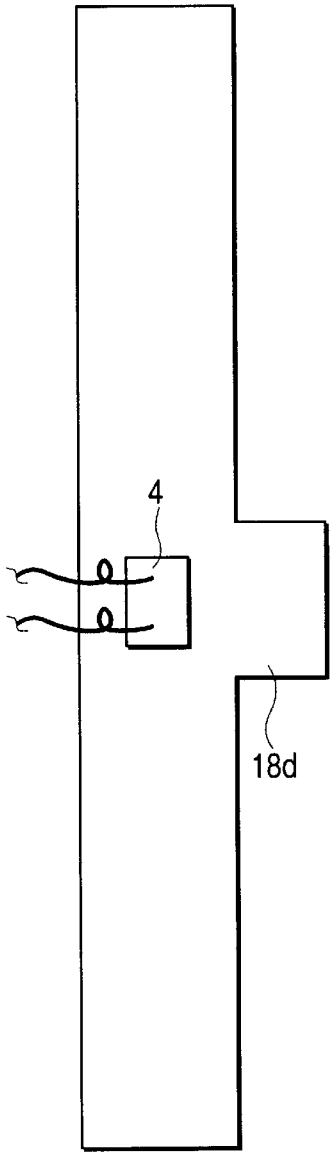
Figure 10C:
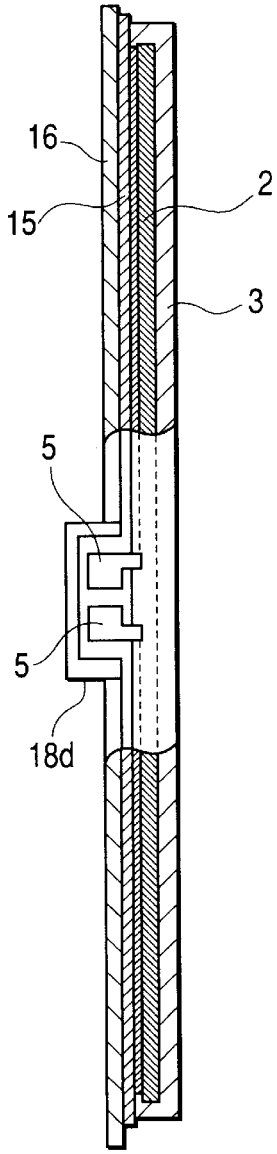
Figure 11:
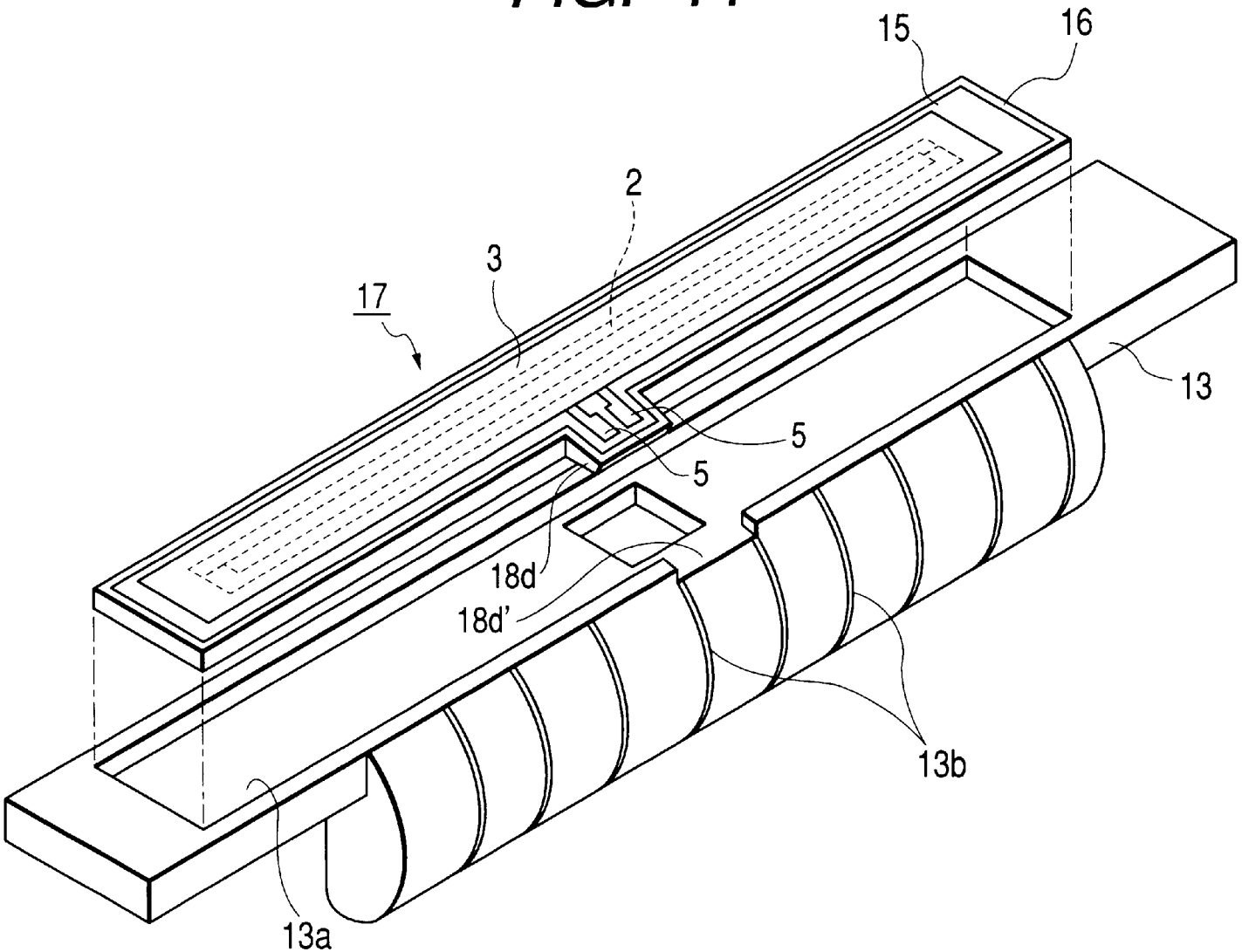
FIG. 11 is an exploded perspective model view of the heater and a stay.

FIGS. 9A and 9B are model views showing shapes upon expansion of the heater 17 in the seat gouged portion 13*a* of the stay 13, in which FIG. 9A shows a case of the heater 17 in which the positioning means is the board bending portion 18*c*, and FIG. 9B shows a case of the heater 17 in which the positioning means is the hole 18*a*.

Embodiment 3

(FIGS. 10A to 10C and FIG. 11)

Although, in the embodiments 1 and 2, the electrodes 5 for power supply and the positioning means 18*a*, 18*b* and 18*c* are formed at the longitudinal direction end portions of the heater 17, it need not always be at end portions. As shown in FIGS. 10A to 10C and FIG. 11, even when the electrodes 5 and positioning means 18*d* are at the center, contact point defect can be prevented. In this case, since the thermal expansion of the heater 17 is distributed evenly in the longitudinal direction, the thermal distribution in the vertical direction to the paper-passing direction can be designed and realized symmetrically in the left and right.

In this case, since using the connecter as the above-described embodiment interferes with the film, power supply may be soldering of a lead line, or connected to the electrode by spot welding. Wiring of the lead line to the film guide can be freely designed if it does not obstruct sliding of the film.

Others

1) In a heating apparatus of a film heating system, an apparatus construction in which an endless belt-like film is wound and stretched by giving tension, and this is rotated and driven, is also possible. Besides, using an long ended film roll-wound, an apparatus construction is also possible so that this is run at a predetermined speed from the feeding-out axis side through the heater to the winding-up axis side.

2) Besides, it is of course that the heating body of the present invention can be applied to not only the heating apparatus of the film heating system but also a heating apparatus or the like in which a heating body supported by a heating body support body is directly contacted to a heated body and heated or the like.

3) Besides, it is of course that the heating apparatus of the present invention can be widely used as not only the image overheating fixing apparatus but also others, for example, an image heating apparatus in which a recording material carrying an image is heated and the surface property such as gloss is modified, an image heating apparatus which performs temporary fixing processing, a heating apparatus in which a sheet-like material is fed and dry processing and laminate processing are performed or the like.

The present invention is not limited to the above-described embodiments but includes modifications within its the scope of the preset invention.

What is claimed is:

1. An image heating apparatus comprising:

a heating member for heating an image on a recording material, said heating member having a metallic substrate and heat generating resistor; and a supporting member for supporting said heating member, wherein said metallic substrate having a positioning portion for positioning said metallic substrate on said supporting member.

2. An image heating apparatus according to claim 1, said heating member further having electrodes for supplying an electrical power to said heat generating resistor, wherein said positioning portion is arranged near said electrodes are provided.

3. An image heating apparatus according to claim 2, said electrodes being arranged at an end portion of said metallic substrate in a longitudinal direction.

4. An image heating apparatus according to claim 2, said electrodes being arranged at an central portion of said metallic substrate in a longitudinal direction.

5. An image heating apparatus according to claim 1, said positioning portion being a hole arranged on said metallic substrate.

6. An image heating apparatus according to claim 1, said positioning portion being a bent portion of said metallic substrate.

7. An image heating apparatus according to claim 1, an insulating layer is formed on said metallic substrate, and said heat generating resistor is formed on said insulating layer.

8. An image heating apparatus according to claim 1, further comprising a film moving in contact with said heating member and a pressing roller for forming a nip in cooperation with said heating member, with said film being interposed.

9. A heater used in an image heating apparatus, comprising:

a metallic substrate;

a heat generating resistor;

wherein said metallic substrate having a positioning portion for positioning said metallic substrate on said image heating apparatus.

10. A heater according to claim 9, said heating member further having electrodes for supplying an electrical power to said heat generating resistor, wherein said positioning portion is arranged near in the said electrodes.

11. A heater according to claim 10, said electrodes being arranged at an end portion of said metallic substrate in a longitudinal direction.

12. A heater according to claim 10, said electrodes being provided at an central portion of said metallic substrate in a longitudinal direction.

13. A heater according to claim 9, said positioning portion being a hole arranged on said metallic substrate.

14. A heater according to claim 9, said positioning portion being a bent portion of said metallic substrate.

15. A heater according to claim 9, an insulating layer is formed on said metallic substrate, and said heat generating resistor is formed on said insulating layer.

16. A heater used in an image heating apparatus, comprising:

a substrate, said substrate having a positioning portion for positioning said substrate on said image heating apparatus;

a heat generating resistor;

wherein said positioning portion is provided in the interior of said substrate.

17. A heater according to claim 16, said heating member further having electrodes for supplying an electrical power to said heat generating resistor, wherein said positioning portion is arranged near said electrodes.

18. A heater according to claim 17, said electrodes being provided at an end portion of said substrate in a longitudinal direction.

19. A heater according to claim 17, said electrodes being arranged at an central portion of said substrate in a longitudinal direction.

20. A heater according to claim 16, said positioning portion being a hole provided on said substrate.

21. A heater according to claim 16, wherein an insulating layer is formed on said substrate, and wherein said heat generating resistor is formed on said insulating layer.

* * * * *

UNITED STATES PATENT AND TRADEMARK OFFICE

CERTIFICATE OF CORRECTION

PATENT NO. : 6,455,811 B2
DATED : September 24, 2002
INVENTOR(S) : Yasumasa Otsuka It is certified that error appears in the above-identified patent and that said Letters Patent is hereby corrected as shown below:

Title page,
Item [57], ABSTRACT,
Line 6, “contact inferior” should read -- inferior contact --.
Line 9, “uneven” (2nd occurrence) should be deleted.
Line 10, “is occurred.” should read -- occurs. --.

Column 1,
Line 41, “One” should read -- One factor --.
Line 44, “are” should be deleted.
Line 45, “in” should read -- to --.

Column 2,
Line 22, “does” should read -- denotes --.

Column 4,
Line 1, “contact inferior” should read -- inferior contact --.
Line 5, “uneven” (2nd occurrence) should be deleted.
Line 6, “is occurred.” should read -- occurs. --.
Line 10, “to a” should read -- to provide a --.
Lines 25 and 32, “having” should read -- has --.

Column 6,
Line 9, “and” should read -- and is --.

Column 8,
Line 44, “this” should read -- these --.

Column 9,
Line 28, “be not” should read -- not be --.

UNITED STATES PATENT AND TRADEMARK OFFICE

CERTIFICATE OF CORRECTION

PATENT NO. : 6,455,811 B2
DATED : September 24, 2002
INVENTOR(S) : Yasumasa Otsuka It is certified that error appears in the above-identified patent and that said Letters Patent is hereby corrected as shown below:

Column 11,
Line 17, “preset” should read -- present --.
Line 24, “having” should read -- has --.
Line 30, “near” should read -- near where --.
Line 44, “an” should read -- wherein an --.

Column 12,
Line 23, “an” should read -- wherein an --.

Signed and Sealed this

Eleventh Day of March, 2003

JAMES E. ROGAN
*Director of the United States Patent and Trademark Office*